United States Patent [19]

Hottenroth et al.

[11] Patent Number: 4,730,597

[45] Date of Patent: Mar. 15, 1988

[54] BIOMASS STOVE

[76] Inventors: Fred W. Hottenroth, 1740 Interlachen St., Seal Beach, Calif. 90740; Fred W. Hottenroth, III, 411 S. Country Dr., Anaheim, Calif. 92807

[21] Appl. No.: 889,359

[22] Filed: Jul. 25, 1986

[51] Int. Cl.[4] ..... F24C 15/08

[52] U.S. Cl. ..... 126/2; 126/15 R; 126/25 R; 126/59; 126/77; 126/285 A; 110/241

[58] Field of Search ..... 110/235, 241; 126/2, 126/15 R, 25 R, 59, 59.5, 77, 285 A

[56] References Cited

U.S. PATENT DOCUMENTS

| | | | |
|---|---|---|---|
| 747,100 | 12/1903 | Stockton | 126/2 |
| 2,035,167 | 3/1936 | Korach | 110/241 |
| 2,936,724 | 5/1960 | Bishop | 126/77 X |
| 3,159,120 | 12/1964 | Sherman | 110/241 X |
| 3,327,698 | 6/1967 | Leslie | 126/25 R |
| 3,330,232 | 7/1967 | Wagle | 110/241 X |
| 3,361,093 | 1/1968 | Heitz | 126/59.5 X |
| 3,362,394 | 1/1968 | Cole et al. | 126/63 |
| 3,581,731 | 6/1971 | Schulze | 126/25 R |
| 4,471,751 | 9/1984 | Hottenroth et al. | 126/25 R |

*Primary Examiner*—Randall L. Green
*Assistant Examiner*—Allen J. Flanigan
*Attorney, Agent, or Firm*—Herb Boswell

[57] ABSTRACT

A biomass stove has an outer chamber formed by a continuous side wall which is connected to a bottom wall. An air inlet is formed in the bottom wall for allowing introduction of air into the interior of the outer chamber. A fuel basket, also formed as a continuous side wall attached to a bottom wall, is located within the outer chamber. In the fuel basket, near the bottom of the fuel basket, a grate is positioned. First and second reflecting members are positioned below the grate within the fuel basket. Air inlets are located along the bottom periphery of the fuel basket with primary air flowing up through the air inlets and over the reflecting members and through the grate into a fuel supply which can be located within the fuel basket on the grate. One or more of the primary stoves can be suspended in a support housing to form an appropriate multi-burner stove.

18 Claims, 5 Drawing Figures

BIOMASS STOVE

BACKGROUND OF THE INVENTION

This invention is directed to a biomass stove which utilizes a fuel basket having a grate near the bottom of the basket and a reflecting surface below the grate. The fuel basket is positioned within an outer chamber which has an air control mechanism to control air flow into the fuel basket.

In many parts of the world which do not have centralized energy distribution systems, the primary energy source for the population of these areas is biomass. Unfortunately in many of these same areas, the use of the available biomass is at a rate greater than a rate at which the biomass is replenished. In these areas fuel is, therefore, extremely scarce and is a precious commodity which must be wisely used.

Unfortunately, in many of the same areas wherein fuel is extremely scarce, the population of these areas still rely on outmoded technology for the construction of heating stoves, hearths, and the like. Sand, mud, and brick are extremely energy wasteful materials to utilize in the construction of heating and cooking stoves.

BRIEF DESCRIPTION OF THE INVENTION

In view of the above it is the broad object of this invention to provide a heating and cooking stove which uses available biomass for it's fuel. It is a further object to provide a stove which can be constructed of inexpensive materials utilizing unsophisticated construction methods and labor. It is a further object to provide a stove which extracts as much heat as possible from the fuel available so as to allow for conservation of precious fuel.

These and other objects as will become evident from the remainder of this specification are achieved in a stove which comprises an outer chamber having a hollow interior. The hollow interior is formed by an outer chamber bottom wall and an essentially continuous outer chamber side wall which connects to the bottom wall. The outer chamber has a top opening into the hollow interior of the outer chamber. An air inlet means is provided for introducing air into the interior of the outer chamber with the air inlet means being located in at least one of the outer chamber bottom wall or the outer chamber side wall. A fuel basket having a hollow interior is provided for containing fuel. The fuel basket including an essentially continuous fuel basket side wall surrounding the fuel basket hollow interior. The fuel basket side wall has a top edge and a bottom edge. The fuel basket is sized and shaped so as to be at least partially temporarily locatable in the outer chamber. The fuel basket has an essentially open top opening into the hollow interior of the fuel basket. A grate is located in the hollow interior of the fuel basket and is positioned within the hollow interior of the fuel basket spaced upwardly from the bottom edge of the fuel basket side wall. A reflecting mass is provided for reflecting heat. The reflecting means is located in the fuel basket below the grate and spaced upward from the bottom edge of the fuel basket side wall. A fuel basket air inlet means is provided for introducing air into the fuel basket with at least a portion of the fuel basket air inlet means formed in the fuel basket side wall below the grate.

In a preferred embodiment of the invention, both the outer chamber side wall and the fuel basket side wall are formed as continuous surfaces of rotation. This construction uses the minimum area of construction material for containing a particular charge of fuel. Further, in the preferred embodiment, the reflecting means would include a first reflecting member and a second reflecting member with the first reflecting member located in the bottom of the fuel basket below the grate, and the second reflecting member located beneath the first reflecting member and spaced upwardly from the bottom wall of the fuel basket.

In a preferred embodiment of the invention, the second reflective member would be shaped as an annulus having a circular opening in it's center, and the first reflective member would be shaped as a disk having a diameter approximately equal to the diameter of the opening in the annulus. The annulus shaped second reflecting member would be spaced upwardly from the bottom edge of the fuel basket side wall and the disk shaped first reflective member would be spaced upwardly from the annulus allowing for a tortuous pathway for air flow up through the opening in the annulus past the periphery of the disk and through the grate to a fuel charge held on the grate.

In a further embodiment of the invention, two such stoves could be utilized as separate burners in a support housing so as to from a multi-burner stove.

In all of the embodiments of the invention, since the fuel basket can be readily removed from the remainder of the stoves of the inventions, the fuel baskets is disposable and can be easily replaced with a new fuel basket or a fuel basket having a different configuration of air inlet openings.

BRIEF DESCRIPTION OF THE DRAWINGS

This invention will be better understood when taken in conjunction with the drawings wherein.

Figure 1:
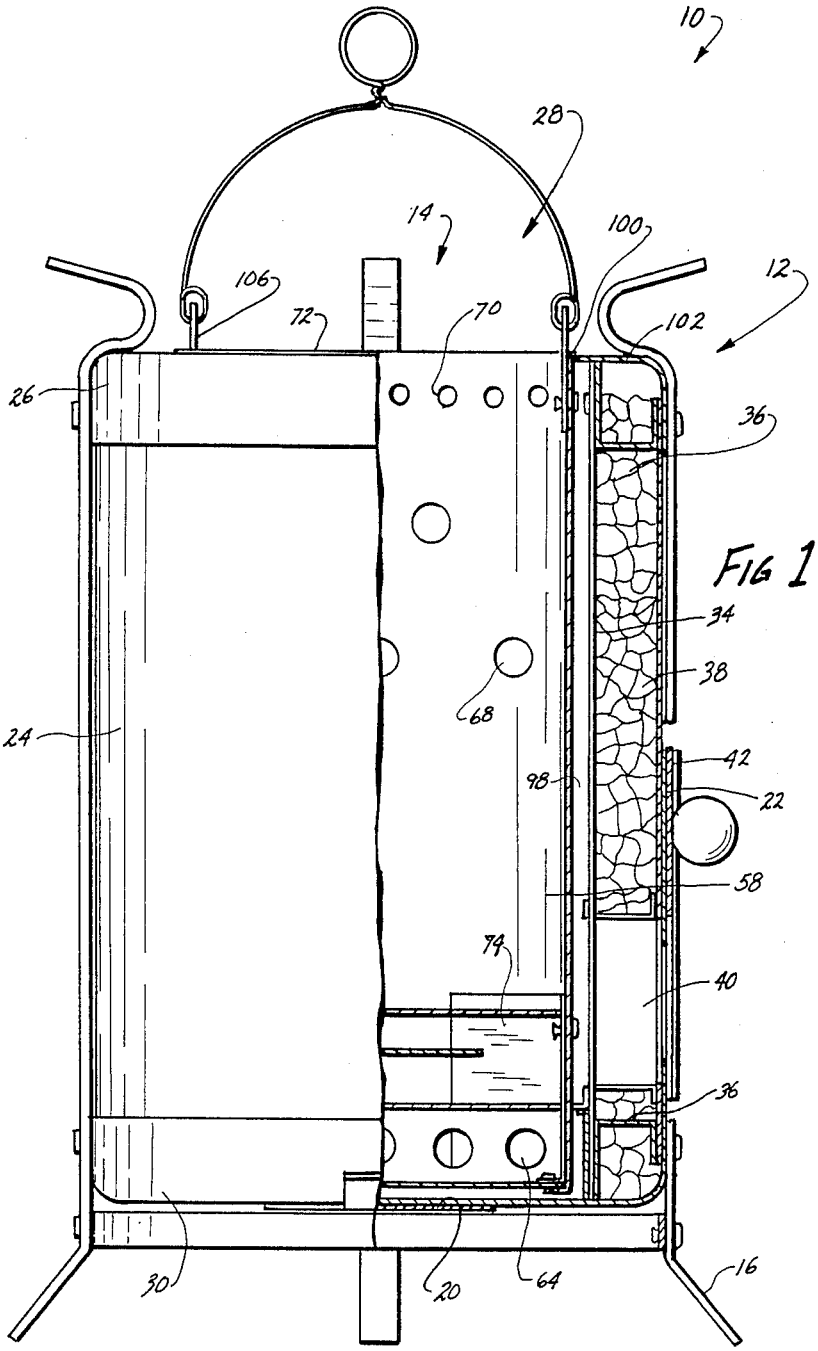
FIG. 1 is a front elevational view in partial section of a stove of the invention.

This invention utilizes certain principles and/or concepts as are set forth in the claims appended hereto. Those skilled in the stove manufacturing arts will realize that these principles and/or concepts are capable of being applied to a variety of embodiments which may differ from the exact embodiment utilized for illustrative purposes herein. For this reason this invention is not to be construed as being limited solely to the illustrative embodiments but should only be construed in view of the claims.

DETAILED DESCRIPTION OF THE INVENTION

In the figures there is shown a stove 10 of the invention. The stove 10 has two component parts, an outer casing generally identified by the numeral 12, and a fuel basket or fuel bowl generally identified by the numeral 14. The fuel bowl 14 is retractable into and out of the outer casing 12. This allows for withdrawal of the fuel bowl 14 for dumping ashes and the like from it, and also for replacement of the fuel bowl 14.

The outer casing is supported by legs collectively identified by the numeral 16 (3 of which are seen in the drawings). These legs support the outer casing 12 above a typical support surface and include a bend 18 at their upper end which for the purposes of the embodiment illustrated in FIG. 1 whould be utilized to support a pot on top of the stove 10.

In the embodiment of the stove illustrated in FIG. 1, a damper 20 is located on the bottom of the outer casing 12 and is utilized to control primary air flow through the stove 10. In this embodiment, a secondary damper 22 is located on the side of the outer casing 12 and is utilized to control the addition of further secondary air into the stove 10 as may be needed for control of fuel burning within the stove 10. In other embodiments of the invention, a secondary damper would not be used. In these embodiments, all air would be supplied and controlled by the damper 20.

An outer housing wall 24 is shaped as a surface of rotation, i.e., as a cylinder. Attached to the outer housing wall 24 is an outer casing cap 26 having a central opening 28 located therein allowing for insertion and removal of the fuel basket 14 as well as charging of fuel into the fuel basket 14 and escape of hot gases from fuel burning within the fuel basket 14. A bottom member 30 attaches to the lower periphery of the outer housing wall 24. A support ring 32 attaches to the bottom of the leg 16 for maintaining the bottom of the legs 16 in position without conducting stress to the attachment points of the legs 16 to the bottom member 30.

The outer housing wall 24 is formed as a ring and is riveted in this shape by lapping the ends of the cylindrical surface of this wall and using appropriate rivets for connecting the same. The upper flange 26 and bottom member 30 are then attached concurrently with the legs 16 to the outer housing wall 24. This is done utilizing small sheet metal screws or like connectors.

An outer chamber wall 34 is also formed as a cylindrical surface of rotation. It is secured to the outer housing wall 24 using appropriate spacers collectively identified by the numeral 36 which are positioned around the circumference of the outer chamber wall in a spaced array within the outer housing wall 24. The machine screws which are utilized to connect the outer housing wall 24 to the legs 16 are concurrently also utilized to connect the spacers 36 to that wall. Further, appropriate machine screws located within the hollow interior of the outer chamber wall 34 connect the outer chamber wall 34 to the inside of the spacers 36.

The outer chamber wall 34 is of a diameter smaller than the diameter of the outer housing wall 24 such that a space is formed between these two walls. In one embodiment of this invention this space can be filled with vermiculite 38 or other insulative material. This inhibits heat transfer radially from the outer chamber wall 34 to the outer housing wall 24 to lower the temperature of the outer housing wall 24 to prevent fires or the like.

Figure 4:
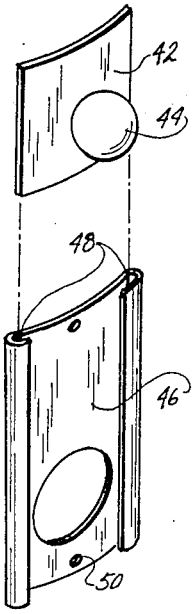
FIG. 4 is an exploded view of certain of the components which are located on the right hand side of the stove of FIG. 1.

If it is desired to introduce additional secondary air, a round opening 40 can be formed between the outer wall 24 and the outer chamber wall 34 so as to provide for secondary air ingress from the ambient into the interior of the outer chamber wall 34. The flow of this additional secondary air is controlled utilizing a secondary damper 42, best seen in FIG. 4. The secondary damper 42 includes a knob 44 located thereon for positioning the secondary damper 42. A secondary damper track member 46 is formed by curving a piece of sheet metal to fit the outside radius of the outer housing wall 24 and then lapping the edges of the sheet metal over so as to form tracks collectively identified by the numeral 48 along each of these edges.

The secondary damper 42 is held in position against the secondary track member 46 by the tracks 48 and is allowed to slide up and down within these tracks so as to either cover the opening 40 or allow a part of it or all of it to be opened to the ambient for allowing secondary air flow into the interior of the outer chamber wall 34. The secondary track member 46 is held to the outer chamber wall 34 by rivets which appropriately pass through openings 50 which serve both to hold the track member 46 to the wall 24 as well as to retain the damper 42 within the tracks 48 after the device is constructed.

Figure 3:
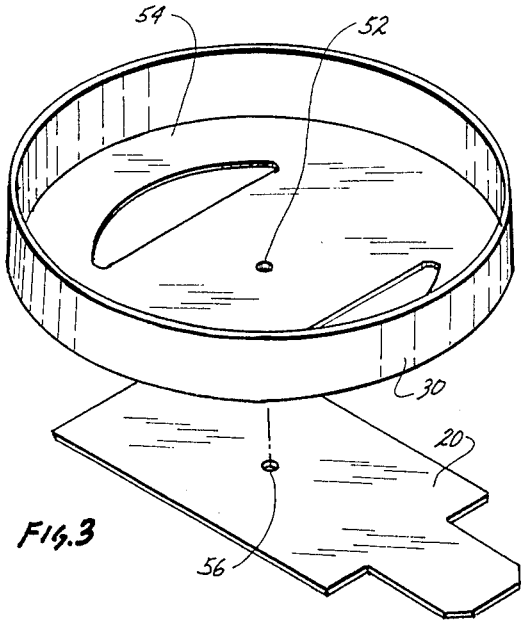
FIG. 3 is an exploded view of certain of the components which are located near the bottom of the stove of FIG. 1.

Looking now at FIG. 3, the bottom member 30 has a small central opening 52 located therein and two hemispherical openings collectively identified by the numeral 54 formed by punching appropriate openings in the member 30. The damper 20 is formed as an elongated rectangular shaped element having an opening 56 whichis mated against the opening 52 and held in position with a loose rivet not separately numbered or shown. The width of the damper 20 is constructed so as to be about equal to the distance between the straight edges of the openings 54, and the length of the damper 20 is constructed so as to be greater than the distance between the arcuate edges of the openings 54 with one end, i.e., the right hand side as seen in FIG. 3 of the damper 20, elongated so as to be accessible to the digits of the user of the stove 10.

When the damper 20 is orientated with respect to the bottom member 30 as seen in FIG. 3, the area of the damper 20 to the left and to the right of the opening 56 is positioned over and closes the openings 54 in the bottom member 30. When the damper 20 is rotated, from the position seen in FIG. 3, since the width of the damper 20 is about equal to the distance of the straight edges of the openings, the damper 20 starts to uncover the openings 54 and, when it is positioned 90° from that seen in FIG. 3, the totality of the openings 54 would be opened allowing for flow of air up through the bottom of the stove 10 into the interior formed by the outer chamber wall 34 and the bottom member 30.

The fuel basket 14 (the bottom portion of which is seen in exploded view in FIG. 2) has a side wall 58 which is formed as a cylinder with the edges 60 of this side wall abutted against one another. A series of small brackets 62 (only one of which is shown in the figures) are utilized to hold the edges 60 in abutment with one another to maintain the cylindrical shape of the fuel basket side wall 58.

A plurality of primary air inlets 64 are located close to the bottom edge 66 of the fuel basket side wall 58. These serve to introduce primary air into the bottom of the interior of the fuel basket 14. A plurality of secondary inlets, collectively identified by the numeral 68, are formed in an array further up on the fuel basket side wall 58 for introduction of secondary air higher up within the fuel chamber within the interior of the fuel basket 14. Finally, a further plurality of secondary air inlets 70 are drilled close to the upper edge 72 of the fuel basket 14. If wood is used as the primary fuel for the stove 10, the air inlets 68 would be located towards the top of the fuel basket 14 in conjunction with the air inlets 70. If charcoal is used as the primary fuel source, the air inlets 68 would be positioned lower along the side wall 58 and the air inlets 70 might not be present.

Figure 2:
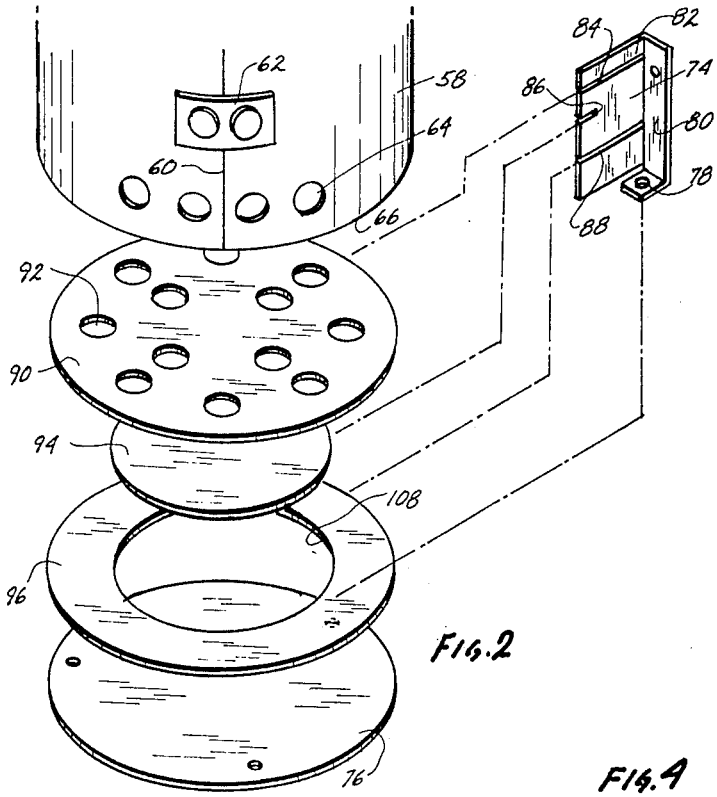
FIG. 2 is an exploded view of certain of the internal components of the stove in FIG. 1.

Three identical brackets 74, one of which is illustrated in both FIGS. 1 and 2, are utilized to hold the bottom 76 of the fuel basket 14 to it's side wall 58 as well as other components of the fuel basket 14 within the fuel basket 14. The brackets 74 are riveted to the bottom 76 by attaching the bottom 76 to a small tab 78 formed by bending an extension of a bracket side piece 80 in a 90° angle to the extension 80. A radially extending wall 82 of the bracket 74 has three slots, upper slot 84, middle slot 86, and lower slot 88 formed therein. The upper slots 84 in the bracket 74 are utilized to hold a grate 90 in position spaced upwardly from the bottom edge 66 of the fuel basket 14. The grate 90 has an appropriate plurality of holes, collectively identified by the numeral 92, to allow for air flow up through the grate 90.

A first reflecting member 94 is formed as a disk of a diameter smaller than the grate 90. This disk is held in the middle slots 86 in the bracket 74. Located below the first reflecting member or disk 94 is a second reflecting member or annulus 96. The annulus 96 is held within the lower slots 88 within the bracket 74. During construction, the grate 90 and the disk 94 and the annulus 96 are simply slid into the appropriate slots in the brackets 74 and fixed into position when the brackets are attached to the bottom 76. The totality of this structure is then slid into the side wall 58 and the bottom 76 is attached to the side wall 58.

The diameter of the fuel basket 14 is slightly less than the inside diameter of the outer chamber wall 34 so as to form a space 98 between these two components when the fuel basket 14 is located within the outer casing 12. The fuel basket 14 is held within this space by bending the upper edge 100 of the fuel basket over so as to form a flange 100 which fits on top of a further appropriate flange 102 formed on the top inside lip of the outer casing cap 26. Positioning of the flange 100 on the flange 102 suspends the fuel basket 14 within the interior of the outer chamber wall 34 with the space 98 formed between the wall 34 and the wall 58.

A bail 104 is attached to the fuel basket 14 utilizing two brackets, collectively identified by the numeral 106, which are riveted to the inside of the fuel basket side wall 58 near it's upper edge 72. The fuel basket 14 can be conveniently lifted from the interior of the outer casing 12 by lifting on the bail 104 for disposal of ash and the like within the fuel basket 14, or for replacement of the fuel basket 14 due to wear and tear of the fuel basket 14 because of the high heat of fuel burning within it's interior.

As is evident from reviewing FIG. 1, air entering through the holes 54 in the bottom member 30 is controlled by the damper 20. This air rises up against the under side of the bottom member 30 and outward toward the outer chamber wall 34. It then passes through the openings 64 in the fuel basket side wall 58. The annulus 96 is formed with an opening 108 in it's center. The diameter of the opening 108 is approximately the same size as the diameter of the disk 94. Primary air entering into the fuel basket 14 through the holes 64 flows toward the center of the fuel basket 14 and upwardly through the opening 108 in the annulus 96. It is then directed outwardly around the outer periphery of the disk 94 and the upwardly again through the holes 92 in the grate 90 and acrossed an appropriate charge of fuel located on top of the grate 90 within the fuel basket 14.

Because the disk 94 is positioned above the annulus 96, any heat radiating downwardly from the grate 90 is reflected back upwardly either by the disk 94 or the surface of annulus 96. Since, however, the annulus 96 has it's opening 108, air can pass upwardly through the annulus 96 and outwardly around the disk 94 to supply primary air to the fuel burning on top of the grate 90.

Preferred as a construction material for everything except the legs 16, the bail 104, the knob 44, and, of course, the vermiculite 38, would be common sheet metal. This is a fairly readily available material in most countries of the world and can easily be worked with common hand tools. Since the totality of the stove 10 is only assembled utilizing either rivets or sheet metal screws, it can be assembled with minimal capital investment in tooling or the like, and, thus, can be readily and inexpensively constructed.

Since the outer chamber 34 and the fuel basket side wall 58 are formed of sheet metal, they serve as heat exchangers for preheating air before it passes into the fuel basket 14. Air passing upwardly through the holes 54 in the bottom 30 under the control of the damper 20, is heated by the metallic surfaces in the bottom of the fuel basket 14 or outer chamber wall 34. This does two things, it heat the air to improve the efficiency of the stove 10 and cools teh internal metallic surfaces of the component parts of the stove 10.

Other known biomass stoves allow extensive heat loss below the grate due to radiation of heat downwardly below the grate. Aside from the decrease in the stoves efficiency due to that downward heat loss, this can also result in a safety hazzard by causing burning or charring of a support surface the stove rest on.

The annulus 96 and the disk 94, because of their shape and location with respect to one another form a radiant heat barrier inhibiting loss of radiant heat downwardly from the grate 90. Further, as primary air moves upwardly from the air inlets 64 it passes across the annulus 96 and the disk 94 and picks up further heat from these reflector surfaces.

Secondary air entering the stove 10 through the opening 40 or through the damper 20, is heated by the fuel basket side wall 58 prior to being introduced into the fuel basket 14 via the secondary air inlets 68. This cools the outer chamber wall 34 and concurrently heats the secondary air for efficiency of the stove 10.

Most of the heat within the stove 10 is maintained within the fuel basket 14 by the presence of the radiators, i.e., the disk 94 and annulus 96, and the side wall 58. If over time, heating of the fuel basket 14 tends to degrade the fuel basket 14, since it can be easily inserted into and withdrawn from the remainder of the stove 10, it is disposable and a new fuel basket 14 can be inserted into the stove 10.

Typically the fire in the fuel basket 14 should be hot enough to burn all carbon monoxide formed but not hot enough to melt the metallic surfaces within the fuel basket 14. The arrangement of the fuel basket 14 within the outer chamber wall 34 and the heat exchange effect achieved by this arrangement in conjunction with the presence of the reflectors 94 and 96 assures that the fire will burn hot enough to burn the carbon monoxide without over heating the metallic components.

Typically the stove 10 can heat a gallon of water to boiling in approximately 11 minutes. This compares very favorably to other small biomass stoves which take on the order of 24 minutes to heat a gallon of water to boiling. The stove 10 is thus very efficient in its use of precious biomass or other fuel.

While for the purposes of illustration, the stove 10 has been shown as being constructed with an outer housing wall 24 and utilizes an insulation material 38 between the housing wall 24 and the outer chamber wall 34, a stove could be constructed without these two components. Such as stove would utilize the outer chamber wall as the external wall of the stove. Alternatively, the housing wall 24 could be used but no insulation would be located between it and the outer chamber wall 34. These alternate construction would be very useful if the stove was primarily going to be used as a space heater.

Figure 5:
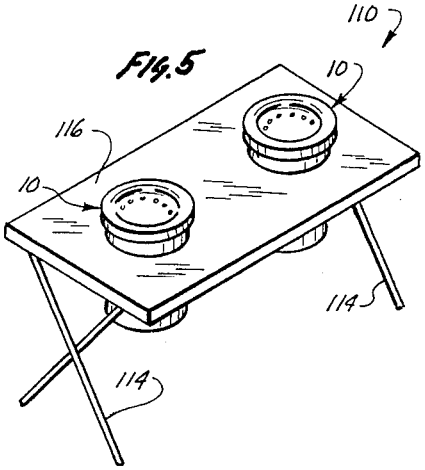
FIG. 5 is an isometric view of a multiple burner stove of the invention.

In FIG. 5 a further embodiment of the invention is shown. In this figure, a multiple burner stove 110 is shown. The multiple burner stove 110 utilizes two individual stoves 10 to form it's two burners. The stove 110 has a upper support plate 112 which is supported on appropriate legs collectively identified by the numeral 114. Openings sized so as to be slightly oversized with respect to the outside diameter of the outer housing walls 24 of the stoves 10, are located in the support plate 112. For use with the stove 110, the upper bends 18 of the legs 16 of the stoves 10 are bent outwardly so as to extend over the upper surface of the support plate 112 to support the stoves 10 on the support plate 112. Further, the lower ends of the legs 16 can be bent inwardly allowing for passing of the stoves 10 downwardly through the openings of the support plate 112.

It is evident that the stove 110 is portable and can be disassembled by simply removing the individual stoves 10 from the appropriate openings in the support plate 112. As is shown in FIG. 5, the multiple burner stove 110 can support a pot, as is illustrated by pot 116 on the left stove 10, and could support a further pot, not separately numbered or shown, on the right stove 10. Further, a radiant heater formed simply as a plate with appropriate radiator fins attached thereto (not separately numbered or shown) could be located on the tops of the one or both of the stoves 10 of the stove 110, or on one of the individual stoves 10 of the previous embodiment for utilizing the stoves of the invention as space heaters.

We claim:

1. A stove which comprises:

an outer chamber having a hollow interior, said outer chamber having an outer chamber bottom wall and an essentially continuous outer chamber side wall operatively connecting to said bottom wall, together said outer chamber side wall and said outer chamber bottom wall surrounding said hollow interior; said outer chamber having an essentially open top opening into said outer chamber hollow interior;

chamber air inlet means for introducing air into said interior of said outer chamber, said air inlet means located in at least one of said outer chamber bottom wall and said outer chamber side wall;

a fuel basket having a hollow interior for containing fuel, said fuel basket including an essentially continuous fuel basekt side wall surrounding said fuel basket hollow interior, said fuel basket side wall having a top edge and a bottom edge, said fuel basket sized and shaped so as to be at least partially temporarily locatable in said outer chamber, said fuel basket having an essentially open top opening into said fuel basket hollow interior;

a grate located in said hollow interior of said fuel basket and positioned within said hollow interior of said fuel basket spaced upwardly from said bottom edge of said fuel basket side wall;

a reflecting means for reflecting heat, said reflecting means located in said fuel basket below said grate and spaced upward from said bottom edge of said fuel basket side wall;

said reflecting means includes a first reflecting element and a second reflecting element, said first reflecting element positioned below said grate, said second reflecting element positioned below first reflecting element and above said fuel basket side wall bottom edge;

fuel basket air inlet means for introducing air into said fuel basket, said fuel basekt air inlet means at least partially located on said fuel basket below said grate means.

2. The stove of claim 1 wherein:

said second reflecting element comprises a flat element having an opening in its center and positioned in said fuel basket so as to connect to said fuel basket side wall and extend essentially perpendicular from said fuel basket side wall.

3. The stove of claim 2 wherein:

said first reflecting element comprises a flat element sized and shaped so as to be larger than said opening in said second element, said first reflecting element operatively positioned in said fuel basket above said second reflecting element so as to extend over said opening in said second reflecting element.

4. The stove of claim 1 wherein:

said fuel basket includes handle means operatively connecting to said fuel basket proximal to said top edge of said fuel basket side wall;

said fuel basket sized and shaped so as to essentially fit within said hollow interior of said outer chamber and to be positioned in and removable from said hollow interior of said chamber with said handle means.

5. The stove of claim 1 wherein:

said fuel basket includes a fuel basket bottom wall connecting to said bottom edge of said fuel basket side wall;

said fuel basket air inlet means including said fuel basket side wall having a plurality of air inlet in said fuel basket side wall adjacent to said bottom edge of said fuel basket side wall.

6. The stove of claim 5 wherein:

said fuel basket air inlet means further includes said fuel basket having a plurality of secondary air inlet ports, said secondary inlet ports positioned in an array in said fuel basket side wall above said grate and below said top edge of said fuel basket side wall.

7. A stove which comprises:

an outer chamber having a hollow interior, said outer chamber having an outer chamber bottom wall and an essentially continuous outer chamber side wall operatively connecting to said bottom wall, together said outer chamber side wall and said outer chamber bottom wall surrounding said hollow interior; said outer chamber having an essentially open top opening into said outer chamber hollow interior;

chamber air inlet means for introducing air into said interior of said outer chamber, said air inlet means located in at least one of said outer chamber bottom wall and said outer chamber side wall;

a fuel basket having a hollow interior for containing fuel, said fuel basket including an essentially continuous fuel basket side wall surrounding said fuel basket hollow interior, said fuel basket side wall having a top edge and a bottom edge, said fuel basket sized and shaped so as to be at least partially temporarily locatable in said outer chamber, said fuel basket having an essentially open top opening into said fuel basket hollow interior;

a grate located in said hollow interior of said fuel basket and positioned within said hollow interior of said fuel basket spaced upwardly from said bottom edge of said fuel basket side wall;

a reflecting means for reflecting heat, said reflecting means located in said fuel basket below said grate and spaced upward from said bottom edge of said fuel basket side wall;

fuel basket air inlet means for introducing air into said fuel basket, said fuel basket air inlet means at least partially located on said fuel basket below said grate means;

said chamber air inlet means includes a damper means for controlling air flow, said damper means located in said outer chamber bottom wall below said reflecting means.

8. The stove of claim 7 wherein:

said outer chamber side wall and said fuel basket side wall are both formed as surfaces of rotation, the size of said surface of rotation of said fuel basket side wall being smaller than the size of said surface of rotation of said outer chamber side wall whereby said fuel basket side wall is spaced away from said outer chamber side wall forming a space between said fuel basket side wall and said outer chamber side wall.

9. The stove of claim 8 wherein:

each of said outer chamber side wall and said fuel basket side wall are formed as cylinders with the diameter of said cylindrical fuel basket side wall being less than the diameter of said cylindrical outer chamber side wall.

10. The stove of claim 9 wherein:

said reflecting means includes a first reflecting element and a second reflecting element, said first reflecting element positioned below said grate, said second reflecting element positioned below first reflecting element and above said fuel basket side wall bottom edge.

11. The stove of claim 10 wherein:

said second reflecting element comprises a flat annulus having an opening in its center and positioned in said fuel basket so as to connect to said fuel basket side wall and extend essentially perpendicular from said fuel basket side wall.

12. The stove of claim 11 wherein:

said first reflecting element comprises a flat disk sized and shaped so as to be larger than said opening in said annulus, said disk operatively positioned in said fuel basket above said annulus so as to extend over said opening in said annulus.

13. The stove of claim 12 wherein:

said fuel basket includes a fuel basket bottom wall connecting to said bottom edge of said fuel basket side wall;

said fuel basket air inlet means including said fuel basket side wall having a plurality of air inlet ports located in an array in said fuel basket side wall adjacent to said bottom edge of said fuel basket side wall below said annulus.

14. The stove of claim 7 wherein:

said chamber air inlet means further includes secondary air inlet means for supplying secondary air into said hollow interior of said outer chamber, said secondary air inlet means located in said outer chamber side wall.

15. A stove which comprises:

an outer chamber having a hollow interior, said outer chamber having an outer chamber bottom wall and an essentially continuous outer chamber side wall operatively connecting to said bottom wall, together said outer chamber side wall and said outer chamber bottom wall surrounding said hollow interior; said outer chamber having an essentially open top opening into said outer chamber hollow interior;

chamber air inlet means for introducing air into said interior of said outer chamber, said air inlet means located in at least one of said outer chamber bottom wall and said outer chamber side wall;

a fuel basket having a hollow interior for containing fuel, said fuel basket including an essentially continuous fuel basket side wall surrounding said fuel basket hollow interior, said fuel basket side wall having a top edge and a bottom edge, said fuel basket sized and shaped so as to be at least partially temporarily locatable in said outer chamber, said fuel basket having an essentially open top opening into said fuel basket hollow interior;

a grate located in said hollow interior of said fuel basket and positioned within said hollow interior of said fuel basket spaced upwardly from said bottom edge of said fuel basket side wall;

a reflecting means for reflecting heat, said reflecting means located in said fuel basket below said grate and spaced upward from said bottom edge of said fuel basket side wall;

fuel basket air inlet means for introducing air into said fuel basket, said fuel basket air inlet means at least partially located on said fuel basket below said grate means;

said stove further includes a housing wall, said housing wall located external of and surrounding said outer chamber side wall, said housing wall of a size greater than the size of said outer chamber side wall whereby said outer chamber side wall is spaced away from said housing wall forming a space between said housing wall and said outer chamber side wall;

insulation means for inhibiting heat loss, said insulation means located in said space between said outer chamber side wall and said housing wall.

16. A stove which comprises:

an outer chamber having a hollow interior, said outer chamber having an outer chamber bottom wall and an essentially continuous outer chamber side wall formed as a surface of rotation and operatively connecting to said bottom wall, together said outer chamber side wall and said outer chamber bottom wall surrounding said hollow interior, said outer chamber having an essentially open top opening into said outer chamber hollow interior;

chamber air inlet means for introducing air into said interior of said outer chamber, said air inlet means located in said outer chamber bottom wall;

a disposable fuel basket having a hollow interior for containing fuel, said fuel basket including an essentially continuous fuel basket side wall formed as a surface of rotation and surrounding said fuel basket hollow interior, said fuel basket side wall having a top edge and a bottom edge, said fuel basket sized and shaped so as to be temporarily contained in said outer chamber, said fuel basket having an essentially open top opening into said fuel basket hollow interior;

a grate located in said hollow interior of said fuel basket and positioned within said hollow interior of said fuel basket spaced upwardly from said bottom edge of said fuel basket side wall;

a first reflecting element and a second reflecting element, said first reflecting element positioned below said grate, said second reflecting element positioned below first reflecting element and above said fuel basket side wall bottom edge;

said second reflecting element comprises a flat annulus having an opening in its center and positioned in said fuel basket so as to connect to said fuel basket side wall and extend essentially perpendicular from said fuel basket side wall;

said first reflecting element comprises a flat disk sized and shaped so as to be larger than said opening in said annulus, said disk operatively positioned in said fuel basket above said annulus so as to extend over said opening in said annulus;

fuel basket air inlet means for introducing air into said fuel basket, said fuel basket air inlet means at least partially located on said fuel basket below said grate means.

17. The stove of claim 16 wherein:

said chamber air inlet means includes a damper means for controlling air flow, said damper means located in said outer chamber bottom wall below said reflecting means;

each of said outer chamber side wall and said fuel basket side wall are formed as cylinders with the diameter of said cylindrical fuel basket side wall being less than the diameter of said cylindrical outer chamber side wall whereby a space is formed between said outer chamber side wall and said fuel basket side wall;

said annulus of a diameter the same as the diameter of the inside of said fuel basket side wall so as to fit against the surface of the inside of said fuel basket side wall;

said disk of a diameter less than the diameter of the inside surface of said fuel basket side wall so as to be spaced way from said surface of said fuel basket side wall.

18. A stove for burning biomass which comprises:

a support housing;

said support housing including at least two burner supports;

at least two burners;

each of said burner including an outer chamber having a hollow interior, said outer chamber having an outer chamber bottom wall and an essentially continuous outer chamber side wall operatively connecting to said bottom wall, together said outer chamber side wall and said outer chamber bottom wall surrounding said hollow interior, said outer chamber having an essentially open top opening into said outer chamber hollow interior;

each of said burners further including air inlet means for introducing air into said interior of said outer chamber, said air inlet means located in at least one of said outer chamber bottom wall and said outer chamber side wall;

each of said burners further including an fuel basket having a hollow interior for containing fuel, said fuel basket including an essentially continuous fuel basket side wall surrounding said fuel basket hollow interior, said fuel basket side wall having a top edge and a bottom edge, said fuel basket sized and shaped so as to be at least partly temporarily contained in said outer chamber, said fuel basket having an essentially open top opening into said fuel basket hollow interior;

each of said burners further including a grate located in said hollow interior of said fuel basket and positioned within said hollow interior of said fuel basket spaced upwardly from said bottom edge of said fuel basket side wall;

each of said burners further including a reflecting means for reflecting heat, said reflecting means located in said fuel basket below said grate and spaced upward from said bottom edge of said fuel basket side wall;

said reflecting means includes a first reflecting element and a second reflecting element, said first reflecting element positioned below said grate, said second reflecting element positioned below first reflecting element and above said fuel basket side wall bottom edge;

fuel basket air inlet means for introducing air into said fuel basket, said fuel basket air inlet means at least partially located on said fuel basket below said grate means.

* * * * *

UNITED STATES PATENT AND TRADEMARK OFFICE

CERTIFICATE OF CORRECTION

PATENT NO. : 4,730,597

DATED : MARCH 15, 1987

INVENTOR(S) : HOTTENROTH ET AL.

It is certified that error appears in the above-identified patent and that said Letters Patent is hereby corrected as shown below:

Column 1, line 29, "it's" should be --its--.

Column 1, line 49, "including" should be --includes--.

Column 1, line 59, "mass" should be --means--.

Column 2, line 12, "it's" should be --its--.

Column 3, line 8, "whould" should be --would--.

Column 4, line 23, "whichis" should be --which is--.

Column 5, line 5, "it's" should be --its--.

Column 5, line 58, "it's" should be --its--.

Column 6, line 25, "heat" should be --heats--.

Column 6, line 26, "teh" should be --the--.

Column 6, line 32, "hazzard" should be --hazard--.

Column 6, line 33, "rest" should be --rests--.

Column 7, line 8, "as" should be --a--.

Column 7, line 17, "it's" should be --its--.

UNITED STATES PATENT AND TRADEMARK OFFICE

CERTIFICATE OF CORRECTION

PATENT NO. : 4,730,597

DATED : MARCH 15, 1987

INVENTOR(S) : HOTTENROTH ET AL.

It is certified that error appears in the above-identified patent and that said Letters Patent is hereby corrected as shown below:

Column 7, line 62, "basekt" should be --basket--.

Column 8, line 16, "basekt" should be --basket--.

Signed and Sealed this

Tenth Day of January, 1989

*Attest:*

DONALD J. QUIGG

*Attesting Officer*

*Commissioner of Patents and Trademarks*